United States Patent [19]

Booker

[11] Patent Number: 4,757,567

[45] Date of Patent: Jul. 19, 1988

[54] SCRAPER

[76] Inventor: Ernest R. Booker, 1229½ 22nd St., Santa Monica, Calif. 90404

[21] Appl. No.: 893,012

[22] Filed: Aug. 4, 1986

[51] Int. Cl.[4] ..... A47L 25/00

[52] U.S. Cl. ..... 15/105; 15/111; 15/236 R; D3/64; D32/46

[58] Field of Search ..... 15/105, 111, 236 R; D3/61–65; D32/46

[56] References Cited

U.S. PATENT DOCUMENTS

| | | | |
|---|---|---|---|
| 619,975 | 2/1899 | Martin | 15/111 |
| 2,075,570 | 3/1937 | Carpenter | 15/DIG. 4 |
| 4,144,611 | 3/1979 | Brown | 15/111 |

FOREIGN PATENT DOCUMENTS

| | | | |
|---|---|---|---|
| 657593 | 3/1938 | Fed. Rep. of Germany | 15/111 |

*Primary Examiner*—Edward L. Roberts
*Attorney, Agent, or Firm*—Timothy T. Tyson

[57] ABSTRACT

A scraper for cleaning an obscuring coating off a game card or lottery ticket. The scraper has a scraper blade on one end and a brush on the other comprised of a rabbit's foot allowing the scraper blade to be used by holding the foot as a handle and the brush to be used by holding the scraper blade as a handle. The scraper is coupled to the rabbit's foot using any one of several different means. One embodiment forms the scraper and coupling means from a metal tube. One end of the tube is cut, trimmed, and flattened to form the scraper. The other becomes the coupling means and is fitted over the ankle end of the rabbit's foot and crimped to the foot with the knuckles on the ends of the bones retained inside the coupling means. Other embodiments form the scraper and coupling means from flat metal. A cup or cylinder is formed, fitted, and crimped onto the ankle end of the rabbit's foot to retain the scraper blade. Other embodiments are fabricated primarily of plastic with a wire around the bones of the rabbit's foot to hold the bones together and secure the plastic portions to the rabbit's foot.

2 Claims, 4 Drawing Sheets

Fig.1.
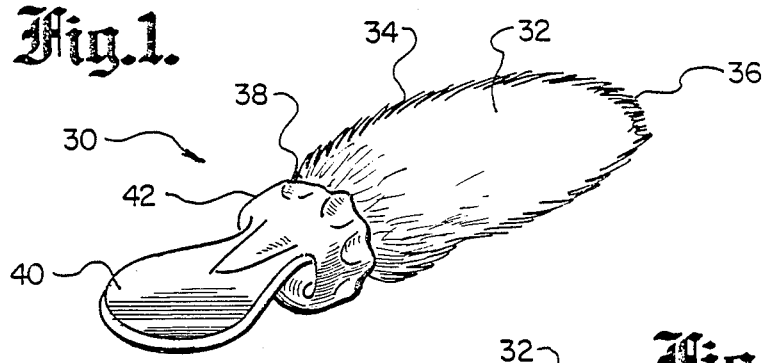
Fig.3.
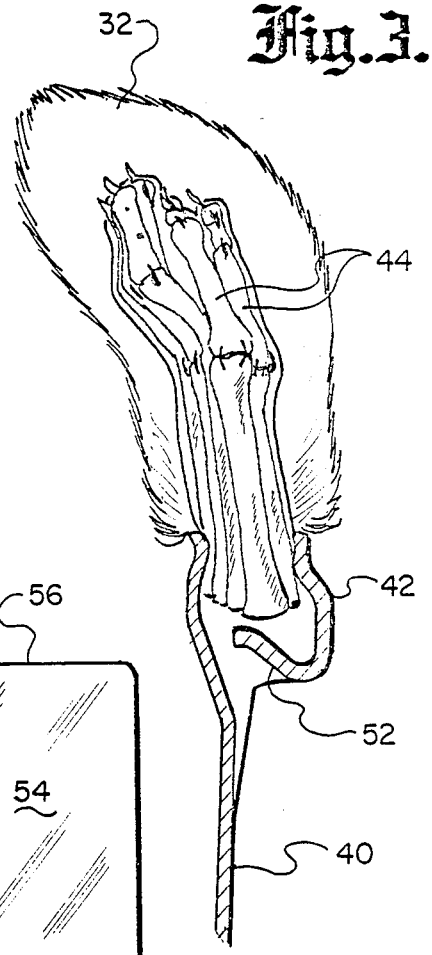
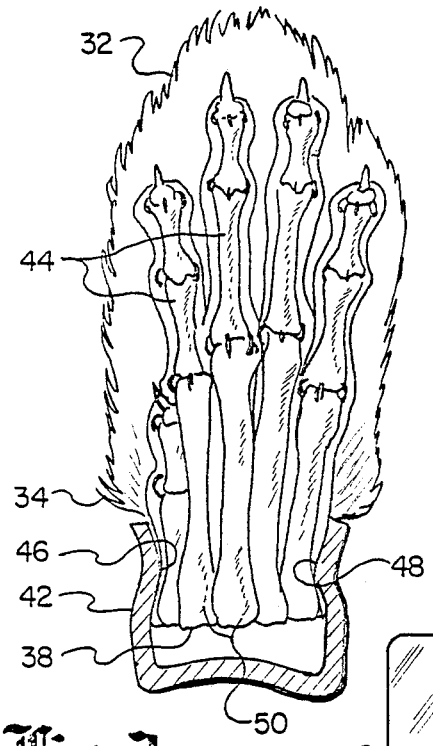
Fig.2.
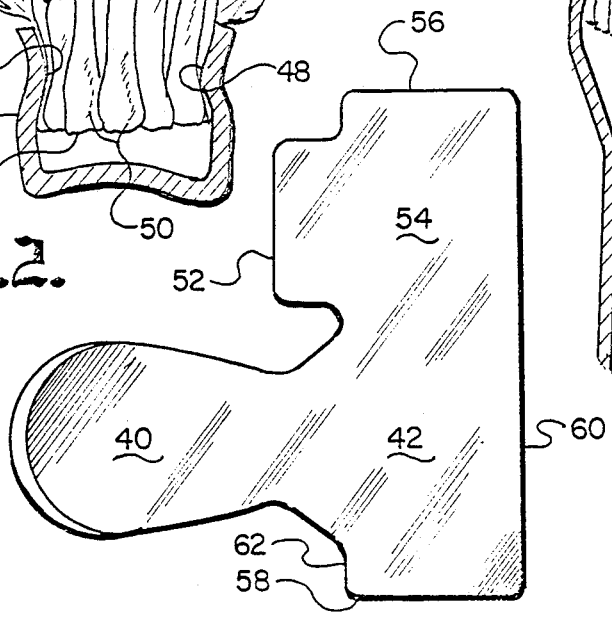
Fig.4.

Fig. 5.
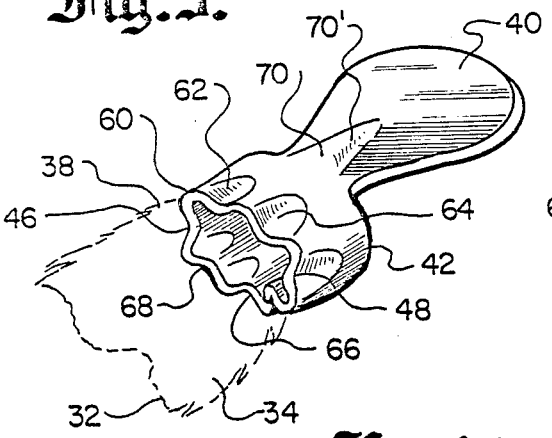
Fig. 6.
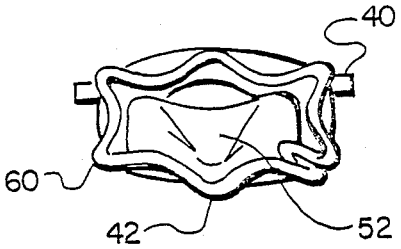
Fig. 11.
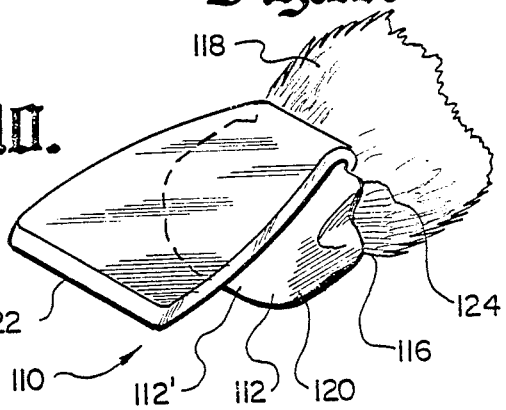
Fig. 10.
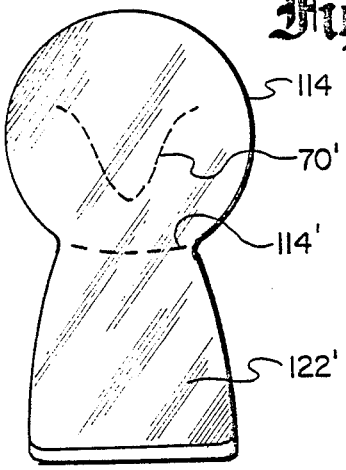
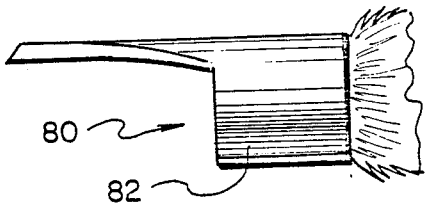
Fig. 9.
Fig. 7.
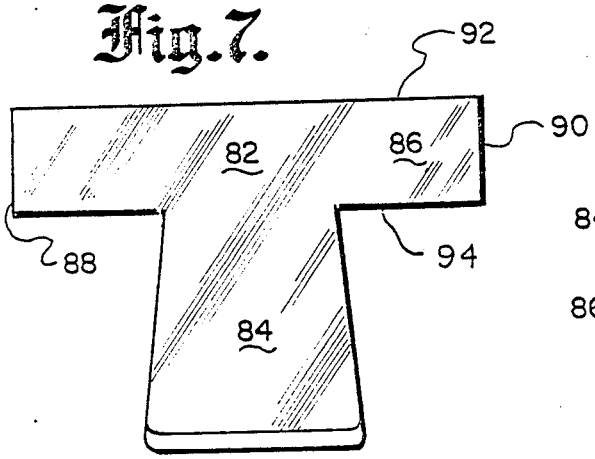
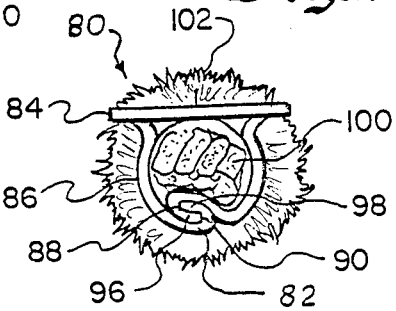
Fig. 8.

Fig. 12.
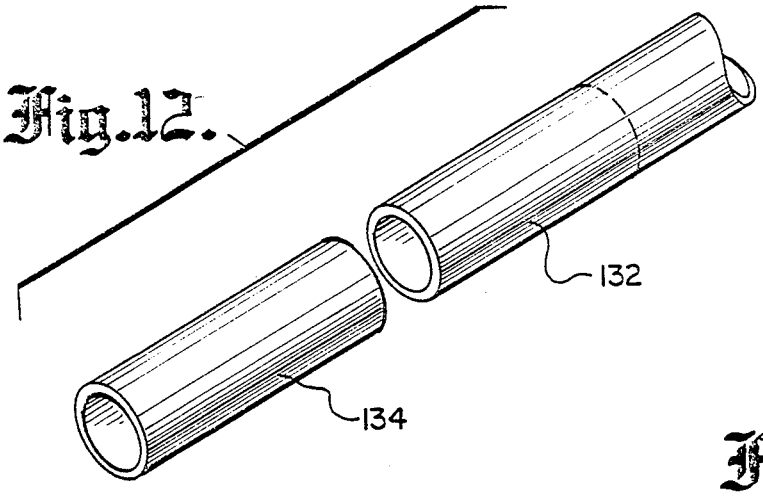
Fig. 16.
Fig. 13.
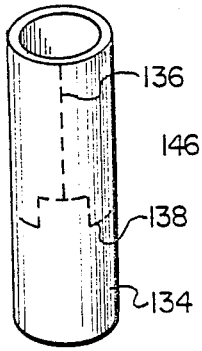
Fig. 14.
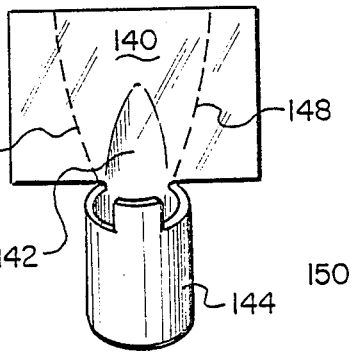
Fig. 15.
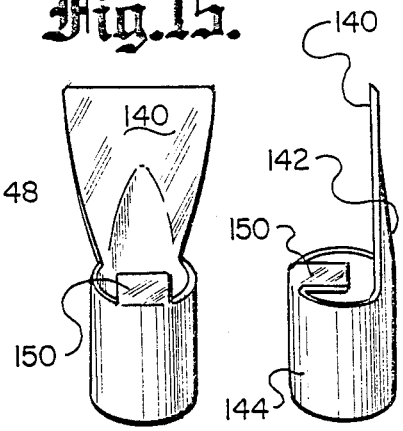
Fig. 17.
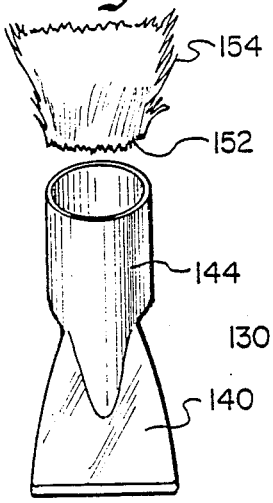
Fig. 18.
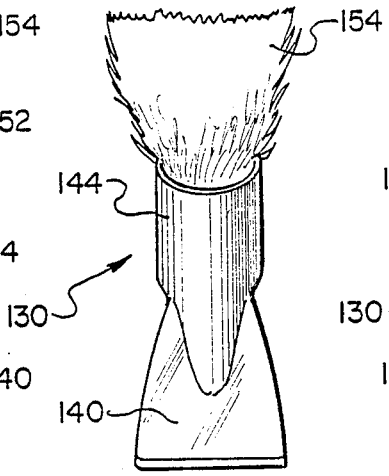
Fig. 19.
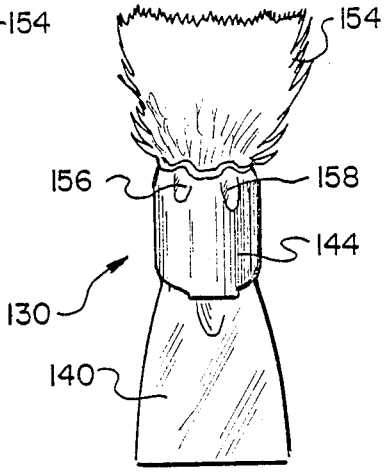

Fig. 20.
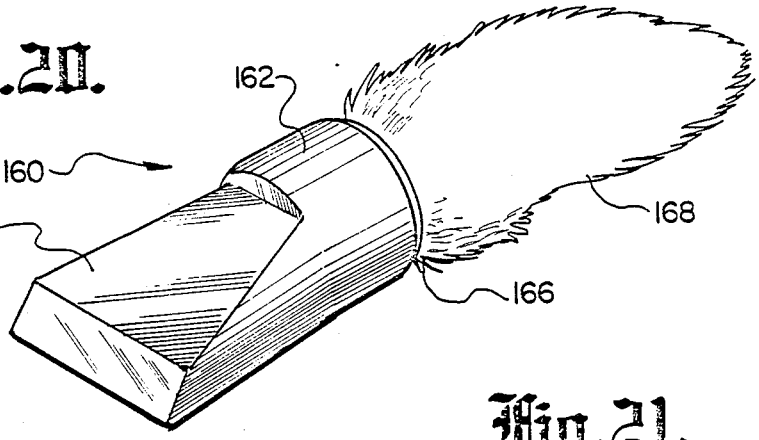
Fig. 21.
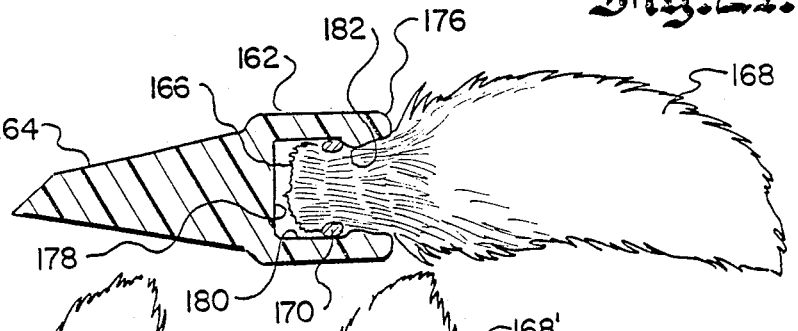
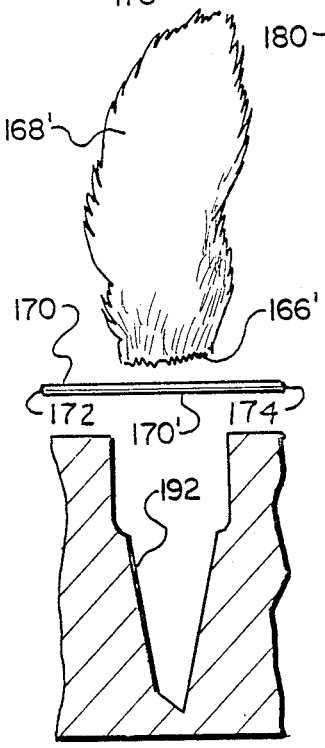
Fig. 22.
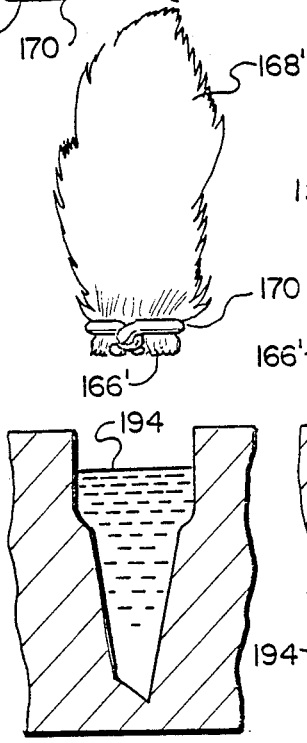
Fig. 23.
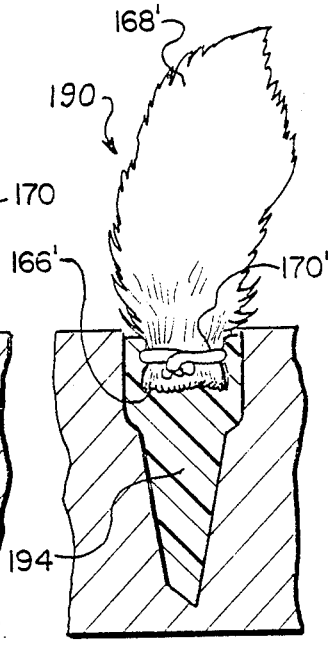
Fig. 24.

SCRAPER

BACKGROUND OF THE INVENTION

1. Field of the Invention

The present invention pertains to the cleaning implement art, and more particularly, to an implement for cleaning an obscuring coating off a game card or lottery ticket having a scraper blade on one end and a brush on the other comprised of a rabbit's foot allowing the scraper blade to be used by holding the foot as a handle and the brush to be used by holding the scraper blade as a handle.

2. Background Art

Many game cards and lottery tickets have obscuring coatings over portions of the cards or tickets which may be scraped away to expose numbers, letters, and/or symbols underneath. Fingernails or coins are often used to remove the coatings. The crumbs from the coatings may then be brushed off the cards or tickets by the tips of the fingers. Any of the sticky crumbs that remain on the fingers may then be brushed off by brushing the fingers together or against the clothing.

Sharp instruments such as knives or metal scrapers may also be used to remove the coatings if care is taken to avoid cutting or scraping the underlying printing and paper.

At least one specialized scraper has been developed to remove the coatings on California lottery tickets. The scraper is a flat piece of thin plastic having an outer edge substantially in the shape of the State of California. A scraper is formed on the southern border by beveling the edge. However, no known specialty scraper and brush combinations are available for removing the obscuring coatings.

Separate brushes have been made in a wide variety of materials. For example, animal hair has long been used as bristles in brushes. Small bunches of hair are collected together and plastic is molded around the bunches in conjunction with an integral plastic handle. Another brush using animal hair is disclosed in U.S. Pat. No. 926,303 where a wire secures a large bunch of hair in place. While brushes such as these might be used to remove the crumbs of obscuring coatings from cards and tickets, no known brush has been particularly adapted for this purpose.

The hair on the side of a rabbit's foot may be used as a brush to clean cards and tickets. Many participants in games of chance carry a rabbit's foot as a good luck charm and could use one for this purpose. The standard rabbit's foot available as a good luck charm is usually mounting with the ankle end in a metal cup crimped on the foot slightly away from the ankle end. The knuckles on the ends of the bones are thereby trapped inside the cup securing the rabbit's foot to the cup. A raised slot in the bottom of the cup allows a key chain to be fastened to the cup. This mounting permits the rabbit's foot to be displayed by hanging around the neck or from a belt loop. While the rabbit's foot could be used as a small brush, it has never been particularly adapted for this purpose or any other practical purpose.

SUMMARY OF THE INVENTION

The present invention is directed to a scraper having a scraper blade and a brush for removing the obscuring coating from game cards and lottery tickets. The scraper is constructed by coupling a scraper blade to the ankle end of a rabbit's foot. The scraper blade is used by grasping the rabbit's foot as a handle and the rabbit's foot is used as a brush by grasping the scraper blade as a handle. In addition to providing scraping and brushing functions, the scraper also serves as a good luck charm.

In accordance with one important aspect of the invention, the scraper blade and the coupling means are fabricated from a single metal tube. A first end of the tube is fitted over the ankle end of the rabbit's foot and is crimped onto the rabbit's foot. A portion of the metal tube adjacent a second end of the tube is flattened to form a scraper blade.

In a preferred embodiment, a cover tab is also fabricated from the metal tube adjacent the scraper blade and bent to visually cover the ankle end of the rabbit's foot.

In accordance with one important aspect of a second embodiment of the invention, the coupling means includes a metal cup crimped on the ankle end. A metal bond between the scraper blade and the metal cup holds the scraper blade on the rabbit's foot.

One feature of the second embodiment is an attachment tab that protrudes from the metal cup substantially parallel to the axis of the cup against the scraper blade.

In accordance with one important aspect of a third embodiment of the invention, the coupling means includes a strip of metal having first and second ends and first and second edges with the strip formed into a cylinder having the first and second ends hooked onto each other. The first edge of the strip is fitted over the ankle end and crimped to the rabbit's foot.

One feature of the third embodiment is fabrication of the strip and scraper blade from a single piece of flat metal. The scraper blade is positioned on the second edge. Another feature of the third embodiment is a cover tab also on the second edge and bent to cover the ankle end.

BRIEF DESCRIPTION OF THE DRAWINGS

FIG. 1 is a perspective view of a scraper in accordance with the present invention;

FIG. 2 is a latitudinal sectional view through the coupling means with the top of the rabbit's foot removed;

FIG. 3 is a longitudinal sectional view through the coupling means and scraper blade with the side of the rabbit's foot removed;

FIG. 4 is a top plan view of the metal piece used to form the scraper blade and a strip type coupling means of FIG. 1 prior to bending;

FIG. 5 is a rear perspective view of the metal piece in FIG. 1 with a portion of the rabbit's foot shown in shadow outline;

FIG. 6 is an end elevational view of metal piece of FIG. 5;

FIG. 7 is a top plan view similar to FIG. 4 of a strip type metal piece of another embodiment prior to bending;

FIG. 8 is a scraper blade end elevational view of the metal piece of FIG. 7 rolled and inserted onto a rabbit's foot;

FIG. 9 is a side elevational view of the scraper of FIG. 8;

FIG. 10 is a top plan view similar to FIG. 7 of a cup type metal piece of another embodiment prior to forming;

FIG. 11 is a perspective view of the metal piece of FIG. 10 formed into a cup, inserted on a rabbit's foot, and crimped in place;

FIG. 12 is a perspective view of a cylindrical metal tube sectioned for a scraper blade and tube type coupling means of another embodiment;

FIG. 13 is a perspective view of the tube indicating the cuts required;

FIG. 14 is similar to FIG. 13 showing the flattened scraper blade;

FIG. 15 is similar to FIG. 14 showing the trimmed scraper blade and bent cover tab;

FIG. 16 is a side elevational view of the metal piece in FIG. 15;

FIG. 17 is a perspective view of an inverted part of the metal piece of FIG. 16 prior to installation of the rabbit's foot;

FIG. 18 is similar to FIG. 17 after installation of the rabbit's foot;

FIG. 19 is similar to FIG. 18 after the metal piece is crimped;

FIG. 20 is a perspective view of a plastic embodiment;

FIG. 21 is a sectional view of the scraper blade and coupling means of the plastic embodiment of FIG. 20;

FIG. 22 is a sectional view of a mold for another plastic embodiment similar to the plastic embodiment in FIG. 20 prior to the wiring of a rabbit's foot;

FIG. 23 is similar to FIG. 22 after the filling of the mold and wiring of the rabbit's foot; and FIG. 24 is similar to FIG. 23 after insertion of the rabbit's foot.

DESCRIPTION OF THE PREFERRED EMBODIMENTS

Referring initially to FIG. 1, there is illustrated a perspective view of a scraper, generally designated 30, of the present invention for removing obscuring coating from game cards or lottery tickets. The scraper 30 includes a foot 32 of a rabbit having an outer surface 34 with hair, a toe end 36, and an ankle end 38. A metal scraper blade 40 is retained on the ankle end 38 of the rabbit's foot 32 by a metal coupling means 42 crimped onto the outer surface 34. The scraper blade 40 is used by holding the rabbit's foot 32 as a handle. Any crumbs of the obscuring coating that remain on a game card or lottery ticket after use of the scraper blade 40 may be brushed away by holding the scraper blade 40 as a handle and using the hair on the rabbit's foot 32 as a brush. In addition to the scraping and brushing functions of the scraper 30, the rabbit's foot 32 serves also as a lucky charm.

FIG. 2 is a latitudinal sectional view through the coupling means 42 of FIG. 1 with the top of the rabbit's foot 32 removed exposing the bones 44 inside. The rabbit's foot 32 is relatively rigid after being prepared for use as a lucky charm by a process well known in the art. The coupling means 42 is fitted over the ankle end, 38 prior to being crimped onto the outer surface 34 of the shank portions of the ankle bones 44 as indicated at the crimp points 46 and 48. The bones 44 have knuckles 50 that prevent the rabbit's foot 32 from being pulled out of the coupling means 42 after the coupling means has been crimped.

FIG. 3 is a longitudinal sectional view through the coupling means 42 and the scraper blade 40 with the side of the rabbit's foot 32 removed exposing the bones 44. A cover tab 52 hides the ankle end 38 of the bones 44 from view.

FIG. 4 is a top plan view of the metal piece used to form the scraper blade 40 and the coupling means 42 prior to bending. The coupling means 42 includes a strip 54 having first and second ends 56 and 58, respectively, and first and second edges 60 and 62, respectively. The scraper blade 40 and the cover tab 52 are positioned on the second edge 62. The strip 54 is rolled into a cylinder similar to the cylindrical shape in FIG. 8. Hooks are formed on the first and second ends 56 and 58 and the first end 56 is hooked onto the second end 58 similar to the hooked ends in FIG. 8.

FIG. 5 is a rear perspective view of the metal piece forming the scraper blade 40 and the coupling means 42 in FIG. 1 with a portion of the rabbit's foot 32 shown in shadow outline. After the strip 54 of the metal piece in FIG. 4 is rolled and hooked at the first and second ends 56 and 58 to form a cylinder, the first edge 60 is fitted over the ankle end 38 of the rabbit's foot 32 and is crimped at the points 46, 48, 62, 64, 66, and 68 onto the outer surface 34. A ridge 70 may also be formed between the coupling means 42 and the scraper blade 40 to add rigidity to the scraper blade.

FIG. 6 is an elevational view of the first edge 60 of the metal piece of FIG. 5. When the rabbit's foot is inserted into the coupling means 42, most of the ankle end of the rabbit's foot is hidden by either the cover tab 52 or the scraper blade 40.

FIGS. 7, 8, and 9 illustrate another strip type embodiment of the scraper, generally designated 80, of the present invention. FIG. 7 is a top plan view similar to FIG. 4 of a metal piece for the scraper 80 prior to bending to fabricate a strip type coupling means 82 and a scraper blade 84. The coupling means 82 includes a strip 86 having first and second ends 88 and 90, respectively, and first and second edges 92 and 94, respectively. The scraper blade 84 is positioned on the second edge 94.

FIG. 8 is an elevational view of the scraper 80 from the end having the scraper blade 84. The strip 86 is rolled into a cylinder and hooks 96 and 98 formed on the first and second ends 88 and 90 to retain the strip 86 in the cylindrical form. The ankle end 100 of the rabbit's foot 102 has been inserted into the coupling means 82 prior to crimping the coupling means in a manner similar to that shown in FIG. 5. FIG. 9 is a side elevational view of the scraper 80 prior to crimping the coupling means 82.

FIGS. 10 and 11 illustrate another embodiment of the scraper, generally designated 110, of the present invention having coupling means in the form of a cup 112. FIG. 10 is a top plan view similar to FIG. 7 of a metal piece prior to bending for use in fabricating the scraper 110. The cup 112 is formed from the circle portion 114. FIG. 11 is a perspective view of the circle portion 114 formed into the cup 112, the ankle end 116 of the rabbit's foot 118 inserted into the cup, and the cup crimped onto the rabbit's foot. The cup 112 has substantially cylindrical side walls 120 and an axis in the center. The scraper blade 122 projects from the edge 124 of the cup 112 and is bent back substantially parallel to the axis.

Alternatively, the cup may be formed separately from the scraper blade and then coupled together by a metal bond such as by soldering or welding. An attachment tab raised from the bottom of the cup substantially parallel to the axis of the cup facilitates the assembly by allowing the scraper blade to be positioned against the tab for bonding. Thus, as shown in FIG. 10, the cup is formed using only the circle portion 114' indicated above the dotted line with an attachment tab 70' separated from the middle also indicated by dotted lines. The circle portion 114' is then formed into a cup 112' as shown in FIG. 11 with the attachment tab 70' jutting out along the axis of the cup as shown in FIG. 5. The scraper blade 122' indicated below the dotted line in FIG. 10 is soldered or welded to the attachment tab 70' and the bottom of the cup 112'. The resulting cup 112' and scraper blade 122' combination is substantially identical in appearance to the coupling means 42 and scraper blade 40 in FIG. 5 from the perspective shown therein.

FIGS. 12 through 19 illustrate the construction of another embodiment of the scraper, generally designated 130, wherein the metal portions are derived from a tube instead of a flat piece. FIG. 12 is a perspective view of a cylindrical metal tube 132 sectioned into a blank 134 for forming a scraper blade and coupling means for the embodiment 130. FIG. 13 is a perspective view of the tube blank 134 indicating the preliminary cuts required by the dotted lines 136 and 138. FIG. 14 is similar to FIG. 13 after the cuts have been made, the scraper blade 140 flattened, and a strengthening ridge 142 pressed into the blade leaving a tubular portion 144 for completing the coupling means. The scraper blade 140 remains to be trimmed as indicated along the dotted lines 146 and 148. The trimmed scraper blade 140 is illustrated in FIG. 15 and the cover tab 150 has been bent into a finished position. FIG. 16 is a side elevational view of the completed metal piece of FIG. 15 showing the relationships between the scraper blade 140, the ridge 142, the tubular portion 144 and the cover tab 150. FIG. 17 is a perspective view of an inverted part of the metal piece of FIG. 16 prior to installation of the ankle end 152 of a rabbit's foot 154 into the tubular portion 144. FIG. 18 shows the scraper 130 after installation of the rabbit's foot 154 into the tubular portion 144. In FIG. 19, the scraper 130 is rotated 180° from the position in FIG. 18 and the tubular portion 144 has been crimped at the points 156 and 158 and elsewhere around the tubular portion locking the tubular portion onto the rabbit's foot 154 in the manner previously illustrated.

FIG. 20 is a perspective view of a plastic embodiment of the scraper, generally designated 160. The coupling means 162 and the scraper blade 164 are unitarily injection molded prior to the insertion of the ankle end 166 of the rabbit's foot 168 into the coupling means.

FIG. 21 is a sectional view of the scraper blade 164 and the coupling means 162 of FIG. 20. Prior to insertion of the rabbit's foot 168, a metal wire 170 (shown in section in FIG. 21) having first and second hooked ends 172 and 174 is wrapped around the ankle end 166 and the ends locked on each other as shown in FIGS. 22 and 23 securing the wire firmly on the rabbit's foot above the knuckles 50 illustrated in FIGS. 2 and 3. The coupling means 162 includes a first end 176 having a cup 178 with an interior surface 180 and a ridge 182 around the interior surface adjacent the first end. The ankle end 166 is positioned inside the cup 178 with the wire 170 retained inside the cup by the ridge.

FIGS. 22, 23, and 24 illustrate another method for fabricating another plastic embodiment of the scraper, generally designated 190, using liquid plastic to surround the ankle end 166' of the rabbit's foot 168' to form the coupling means and the scraper blade. The mold 192 is empty in FIG. 22 and a metal wire 170' has not been secured on the ankle end 166'. In FIG. 23, the metal wire 170' has been secured on the ankle end 166' as described in the preceding paragraph and the mold is filled with liquid plastic 194. In FIG. 24 the ankle end 166' has been inserted into the liquid plastic 194 whereupon the plastic sets encasing the ankle end 166' and the metal wire 170' to retain the rabbit's foot 168' in the plastic.

In view of the above, it may be seen that several embodiments of a scraper incorporating a lucky charm in the form of a rabbit's foot are provided for scraping and brushing an obscuring coating from a game card or lottery ticket. Of course, the structure and method may be variously implemented and variously used depending upon specific applications. Accordingly, the scope hereof shall not be referenced to the disclosed embodiments, but on the contrary, shall be determined in accordance with the claims as set forth below.

I claim:

1. A scraper, comprising:

a foot of a rabbit having an outer surface with hair, a toe end, an ankle end, rigid bones between said toe end and said ankle end inside said outer surface, and said ankle end having a knuckle portion and a reduced shank portion smaller than said toe end and knuckle portion; and a metal tube having:

a first end fitted over said knuckle portion and having crimps rigidly engaging without compressing said reduced shank portion; and a second end having a flattened portion formed into a scraper blade;

whereby said foot of a rabbit is prevented from being removed from said metal tube through either said first or second ends by said crimps hitting said knuckle portion or said toe end and said metal tube and said rabbits foot are a rigid structure.

2. The scraper according to claim 1 and further including a cover tab fabricated from said single metal tube adjacent said scraper blade and bent to cover said ankle end.

* * * * *